United States Patent [19]

Mancini

[11] 4,348,162

[45] Sep. 7, 1982

[54] COMBINATION AUTOCLAVE PUMP AND NOZZLE

[75] Inventor: Derek V. Mancini, Markham, Canada

[73] Assignee: Consumers Glass Company Limited, Etobicoke, Canada

[21] Appl. No.: 99,033

[22] Filed: Nov. 30, 1979

[51] Int. Cl.[3] ..... F04B 39/00; B08B 3/02; B08B 9/00

[52] U.S. Cl. ..... 417/431; 92/78; 134/98; 134/171

[58] Field of Search ..... 417/437, 431, 570; 134/98, 171, 166; 92/79

[56] References Cited

U.S. PATENT DOCUMENTS

| | | | |
|---|---|---|---|
| 1,993,371 | 3/1935 | Jones | 134/98 |
| 2,023,854 | 12/1935 | Petricone | 134/171 |
| 3,693,640 | 9/1972 | Wettlen | 222/148 |
| 3,818,805 | 6/1974 | Johansson | 92/79 |

FOREIGN PATENT DOCUMENTS

| | | | |
|---|---|---|---|
| 923589 | 7/1949 | Fed. Rep. of Germany | 417/570 |

*Primary Examiner*—William L. Freeh

[57] ABSTRACT

The specification describes a fluid dispensing piston pump that is adapted to be cleaned in places without disassembly of the pump. During the cleaning operation the piston of the pump is positioned in an area of larger diameter at the base of the cylinder such that the seal between the piston face and cylinder is broken. Seals are provided for closing the upper end of the cylinder thereby allowing steam or a cleaning fluid which is introduced through the inlet check valve to fill the cylinder and sterilize the piston face and stem members. Steam is then discharged through the outlet check valve.

11 Claims, 7 Drawing Figures

COMBINATION AUTOCLAVE PUMP AND NOZZLE

FIELD OF THE INVENTION

The present invention relates to dispensing and metering devices for fluid materials. In particular it relates to a combination pump and distribution nozzle which is adapted to be sterilized in place without requiring disassembly of the apparatus.

BACKGROUND OF THE INVENTION

Various pumping systems have been proposed for use particularly with the dairy industry, where the device may be cleaned in place without requiring disassembly of the unit. Such systems are of benefit to the packaging industry as substantial time savings are possible because the frequency of pump disassembly is reduced. Furthermore, the constant assembly and disassembly of the pump components makes the units more susceptible to damage and wear thus reducing their expected life.

It is apparent that a pump and dispensing system which did not require constant assembly for sterilization would be favourably received by the dairy industry however, they are also concerned with high quality control standards which can not easily be achieved with a system that is not sterilized daily.

One system that is designed to overcome a number of these problems is disclosed in U.S. Pat. No. 3,693,640, which issued to Wettlan et al., Sept. 26, 1972. This system uses a separate pumping chamber in combination with a dosing tube which dispenses the product to the individual containers. The system is such that the dosing tube may be connected to the piston chamber allowing cleaning fluid, which is circulated throughout the device, to contact the rear face of the piston and the stem of the piston to assure the working surfaces of the pump are contacted by the cleaning fluid. Although this is an improvement over the prior art, it is not completely satisfactory for the dairy industry as rinsing of the dispensing device is only part of the problem with the other requirement being a system that can be sterilized in place such that the quality control standards can be met.

The present invention provides a unique combination of a dispensing pump and distribution nozzle which is adapted to be cleaned in place with all working surfaces of the pump and nozzle sterilized during the cleaning cycle.

SUMMARY OF THE INVENTION

The present invention overcomes a number of the short comings of the prior art devices by providing a fluid dispensing pump and nozzle having an operation position and a cleaning position. The device comprises a normally open ended cylinder having an area of larger diameter adjacent the lower end of the cylinder, and a nozzle member closing the lower portion of the cylinder and containing an outlet check valve. The device further includes a piston member having face and stem portions, with the stem portion extending outwardly along the axis of the open end of the cylinder. An inlet check valve is located below top dead centre of the piston pumping stroke and a sealing means is provided associated, with the piston stem, for engaging the open end of the cylinder when the piston is lowered into the cylinder in preparation for cleaning of the apparatus. During cleaning of the apparatus the piston face is located within the cylinder area of larger diameter and the sealing means associates with the piston stem engages the open end of the cylinder. To steam clean the device a closing means is provided for engaging the nozzle member, such that high temperature steam may be introduced through the inlet check valve to fill the cylinder chamber and nozzle, thereby sterilize the components of the pump and nozzle including the piston face and stem without requiring the disassembly of the apparatus.

The device may also be cleaned by circulating a sterilizing solution through the device as an alternative to sterilizing with steam.

According to an aspect of the invention a control valve is associated with the nozzle closing means for controlling the amount of steam being discharged through the unit.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
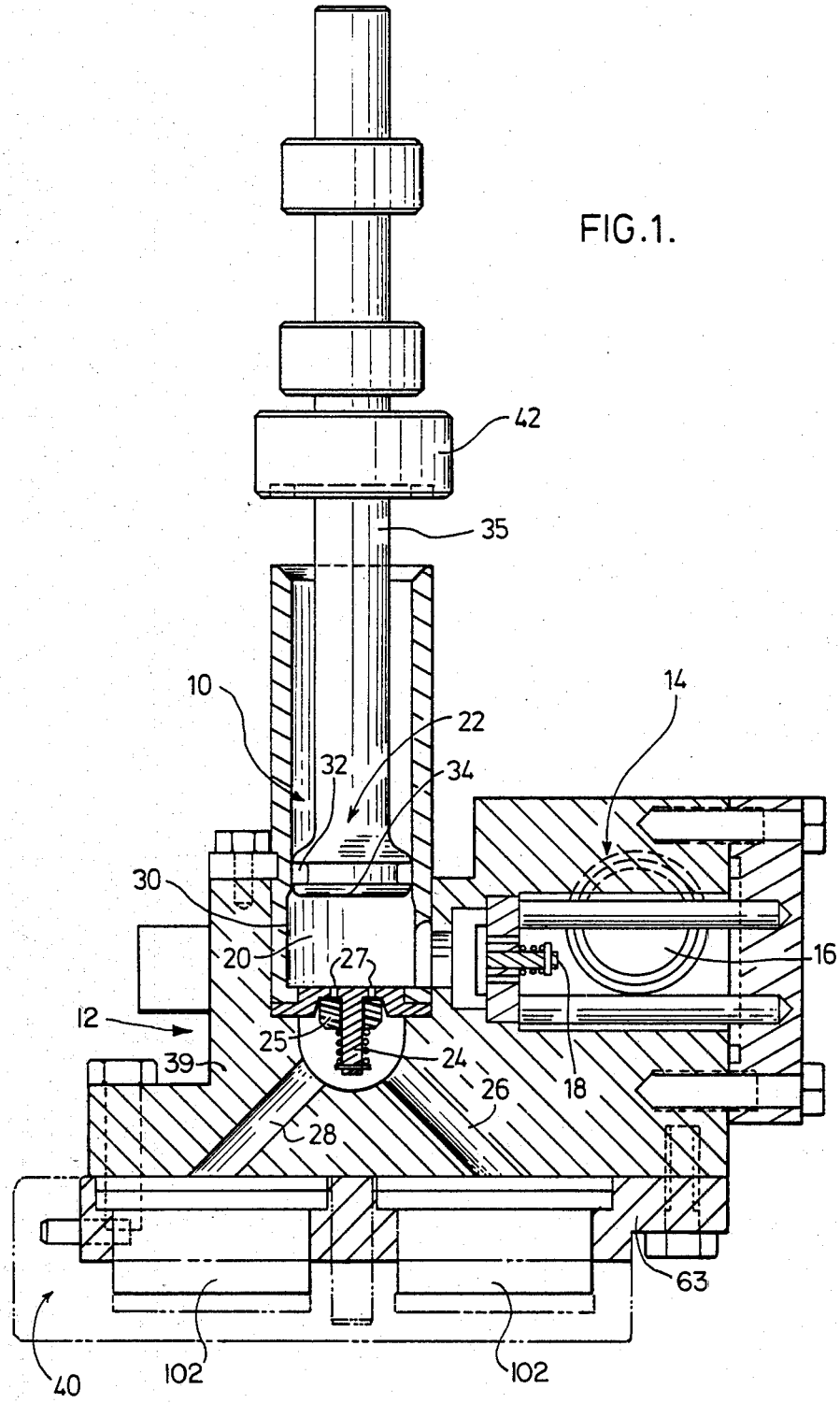
FIG. 1, is a vertical cross-section through a combination pump and nozzle.

As shown in FIG. 1, a pumping unit 10 has been combined with a distribution nozzle system 12 and product feed system 14. The product is fed through the header 16 to the inlet check valve 18 and subsequently to the cylinder chamber 20. On the downward stroke of the piston 22 the product that has been drawn into the cylinder chamber is discharged through outlet check valve 24 and subsequently through ports 26 and 28 to the filling position below. Distribution nozzle system 12 includes body member 39 housing the outlet check valve 24 and outlet ports 26 and 28. A nozzle plate 63 is secured to the body member 39 with nozzles 102 held within the nozzle plate and positioned below one of the outlet ports 16 and 18. Each of these nozzles 102 include a plurality of small outlet conduits 105 (shown in one nozzle of FIG. 2) which cause a stream of product to be loaded into containers. These conduits aim such stream of product to contact the container in a manner to minimize splash of the product outside the container. These conduits have a restricted orfice at the end thereof to minimize the possibility of product dripping from the nozzles during conveyor movement.

Cylinder chamber 20 has been provided with an enlarged bottom portion 30 which allows the O-ring 32 to break its seal with the cylinder wall when lowered into this enlarged portion. The piston 22 during the pumping cycle reciprocates between the position shown in FIG. 1 (top dead centre of the pumping stroke) to a position near the upper extremity of the cylinder. During the pumping cycle the piston face 34 and O-ring 32 do not enter the enlarged cylinder portion 30. On the intake stroke of the pump product is drawn in through the inlet check valve 18, and the outlet check valve 24 remains sealed. On the downward stroke of the pump the inlet check valve is sealed due to the pressure build-up within the cylinder chamber and the outlet check valve 24 opens due to the valve member 25 moving downward and opening the ports 27.

A steam plate 40 has been shown in FIG. 1 in dashed lines and is only used when the pump and distribution system are to be cleaned. To clean the unit the piston member 22 is lowered into the enlarged cylinder portion 30 such that the sealing block 42, which is secured to the piston stem 35, engages the upper portions of the cylinder and forms a seal therewith. The steam plate is then secured to the lower portion of the distribution system and also forms a seal with this system. The steam plate has been designed with an outlet valve for controlling the rate at which steam is discharged from the unit. Steam is introduced through the product feed system 14 and discharged through this control valve and thus the temperature within the complete unit is sufficient to provide sterilization of the working surfaces.

Figure 3:
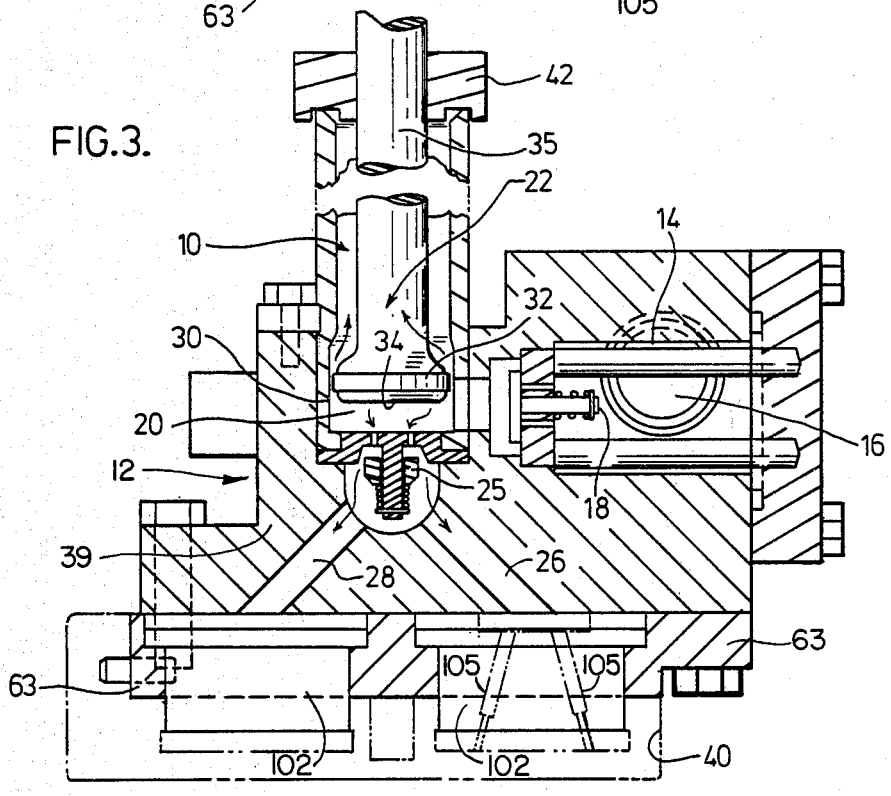
FIG. 3, is a vertical cross-section through the combination pump and nozzle with the piston member positioned for cleaning.

This can be more fully appreciated with reference to FIG. 3 where the device is in the cleaning position. High temperature steam or super heated steam is introduced into the system through header 16 and due to the pressure differential between the header 16 and the outlet valve provided in the steam plate, the inlet check valve 18 and the outlet check valve 24 are open and thus assure all surfaces of these check valves are exposed to the steam. Furthermore, the O-ring 32 which is normally made of silicone material to withstand the steam temperature is positioned approximately opposite the inlet check valve such that steam that passes through the inlet check valve strikes the piston member the O-ring and associated piston groove. Furthermore, the piston face tends to deflect the flow in two directions, one into the upper part of the cylinder chamber and the other towards the outlet check valve. Normally only a mechanical seal is maintained at the upper extremeity the cylinder between the cylinder and sealing means 42, and therefore some steam may escape at this point.

As can be appreciated all surfaces of the cylinder wall and majority portion of the piston stem are exposed to the high temperature steam and are sterilized during the cleaning operation. It is important to be able to control the rate of discharge of the steam through the device as a higher temperature can be maintained within the device if it is pressurized, and this is accomplished by providing a discharge valve on the steam plate for varying the rate at which steam is discharged. The valve is shown schematically in FIGS. 4 and 7 as component 49.

Therefore, during the normal pumping cycle product enters the pump cylinder through inlet valve 18 and is discharged from the cylinder through outlet valve 25. Ports 26 and 28 receive the discharged product and feed it to the nozzles 102 where the produce is discharged through conduits 105.

A similar flow path is used for the passage of steam through the device; however, rather than allowing steam to be released to the atmosphere through conduits 105, a steam plate 41 is secured to cover the nozzles.

Figure 7:
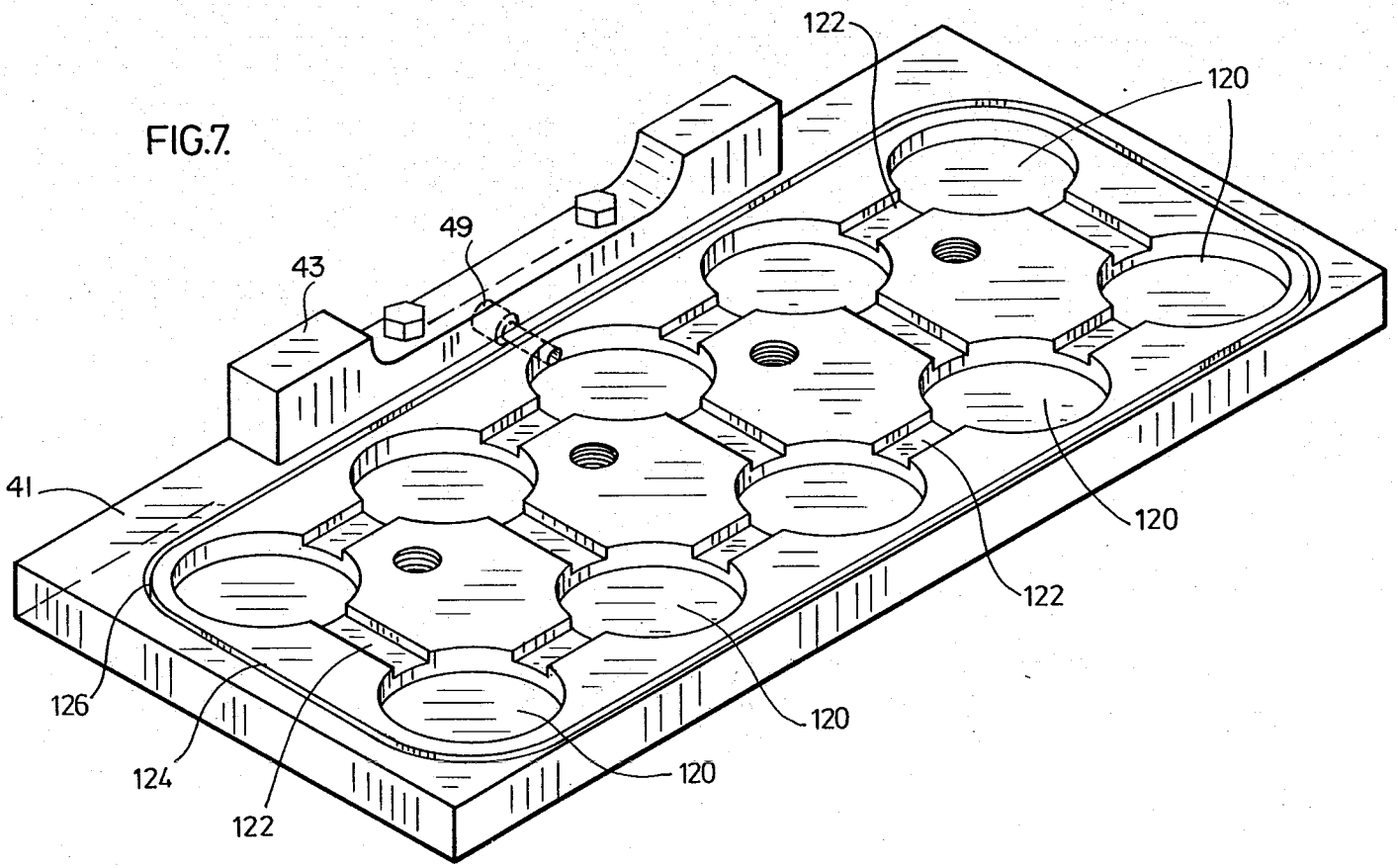
FIG. 7, is a perspective view of a steam plate used during cleaning of the units.

Such a steam plate is shown in FIG. 7 having a number of recesses 120 for alignment with nozzles 102, with each of these recesses interconnected by channels 102, whereby steam discharged from the nozzles is released to the atmosphere through valve 49.

Although the pumping unit has been explained with reference to cleaning with steam, it can also be sterilized by use of a sterilizing fluid, such as iodine, which is circulated through the pump following the same path as the steam. If this is the case, the normal procedure would include flushing the unit with a cleaning fluid, then circulate an acid solution such as vinegar, followed by the sterilizing solution. Often the sterilizing solution may be left to sit in the unit until the next start-up at which time the unit will be flushed. During the cleaning cycle, the piston will be in the cleaning position and the fluids will be circulated or supplied by another pump. If it is preferred to clean in place with a sterilizing solution, it may be necessary to enlarge the discharge valve 49 on the steam plate, such that a higher flow rate is possible.

Figure 2:
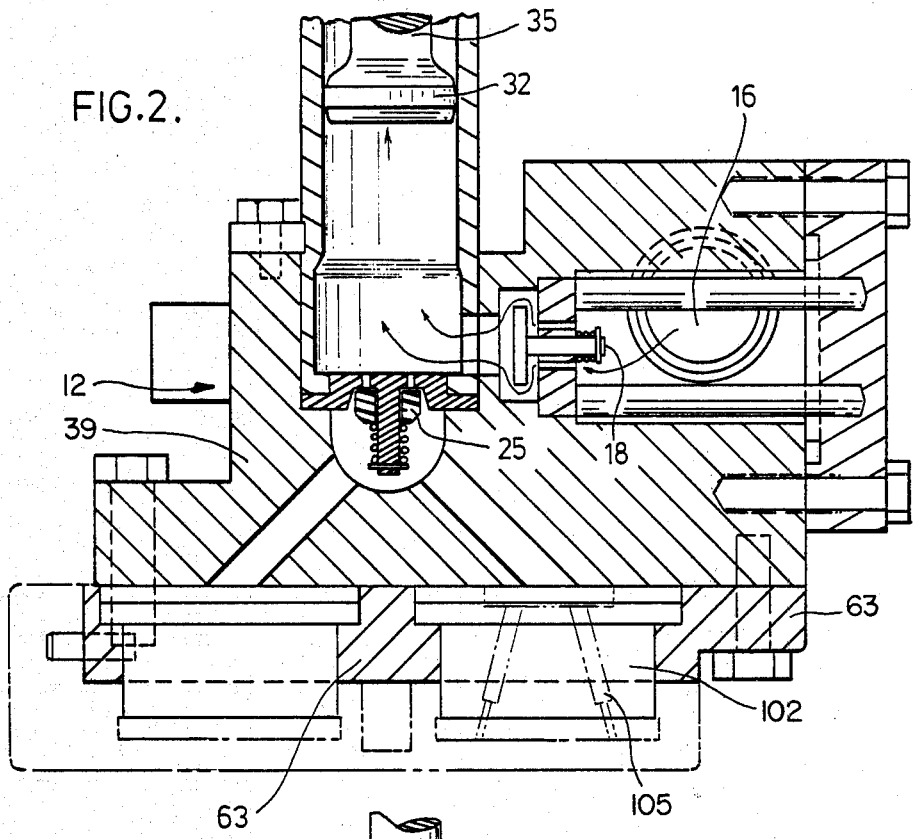
FIG. 2, is a similar cross-section to that of Figure showing the piston during the intake stroke.

The intake piston stroke is shown in FIG. 2 with the product being drawn in through the inlet check valve and into the cylinder chamber due to the upward movement of the piston, and with the subsequent pumping stroke of the piston, product is dispensed through the outlet ports 26 and 28 into containers stationed below. As mentioned previously the piston member stops before entering the enlarged cylinder portion 30 and therefore a certain amount of product remains in this enlarged cylinder portion. Although this is somewhat of a problem during start up of the device, several cyles of the piston will prime the pump and assure all subsequent intake strokes of the piston cause product to fill the cylinder chamber. The enlarged cylinder portion always has product in it and as such provides a buffer stock between the piston and the outlet valve. It is clear from FIG. 2 that product is dispensed due to the pressure build up of the piston moving downwards in the cylinder chamber and the fact that the piston does not bottom out, but acts through buffer stock results in a more accurate metering system. Therefore, although this enlarged cylinder portion causes problems during start up these can be easily overcome and actually result in a more efficient metering system during normal running which overshadows the initial start up problems.

Figure 4:
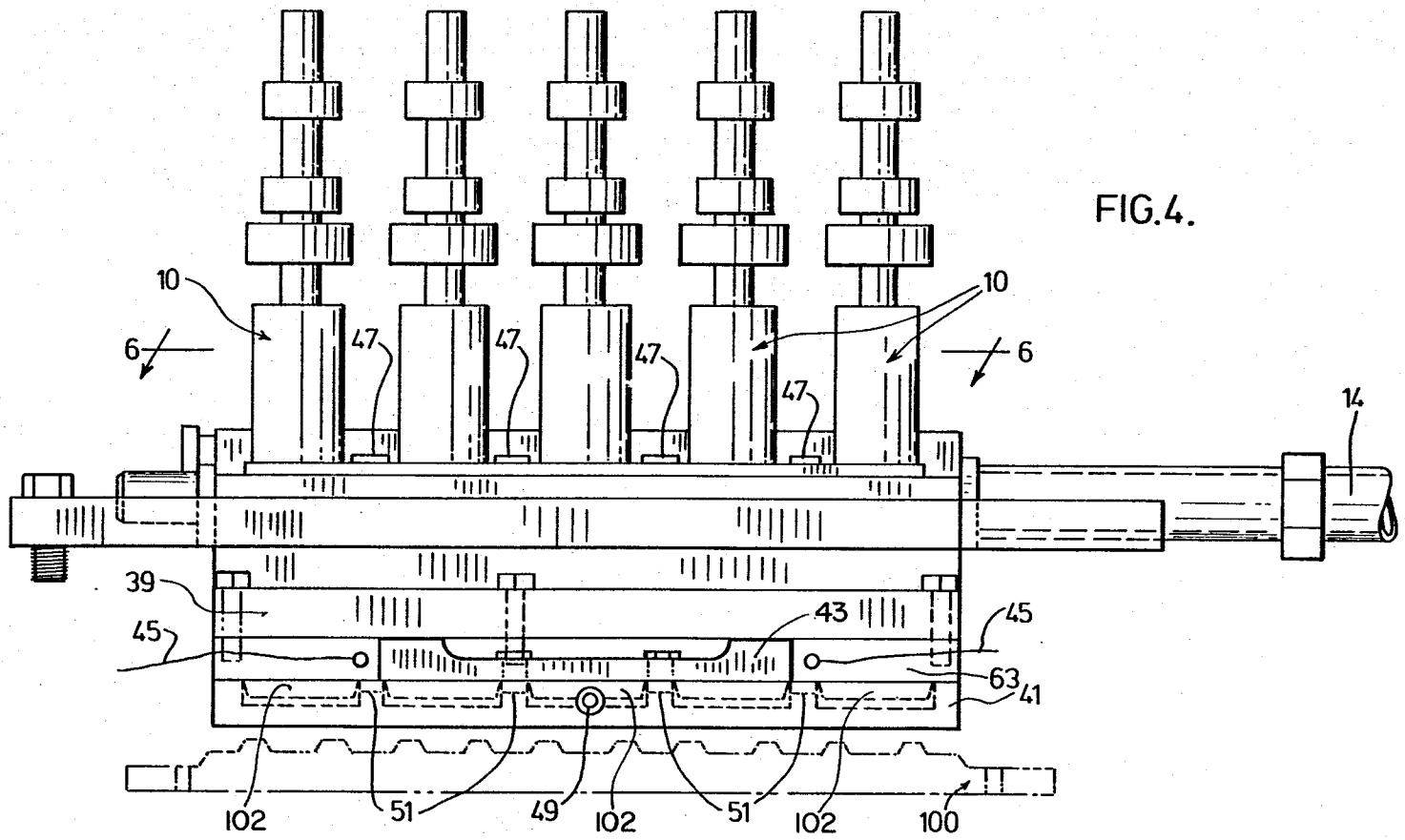
FIG. 4, is a front view of several combination pump and nozzle units located side by side above a conveyor.

Turning to FIG. 4, it can be seen that a number of the pumping and dispensing units 10 have been placed above, and transversing a converyor bed 100. The device has been shown with a common steam cleaning plate 41 which is secured in the cleaning position by bolts 47. This figure also shows the position of the discharge valve 49 which enables the user to vary the rate at which steam is discharged from the overall apparatus during the cleaning process.

The steam plate 41 has been provided with an alignment bracket 43 which is secured to the nozzle plate 63 and cooperates with aligning pegs 45 and the outer surface of nozzle plate 63 for accurate aligning of the nozzle plate. As can be appreciated from FIG. 2, each of the pumping units is designed to feed several filling stations and according to this embodiment the output of the pump is distributed to two filling nozzles which are aligned along the length of the conveyor and thus, each container is filled in two steps to reduce the fill rate without affecting the overall output rate of the machine. This particular method provides accurate product fill quantities as any error between outlet ports in the pump should be constant and hence is corrected due the same container being filled by both distribution ports.

In some circumstances, it will be advantageous to use one pumping unit and several distribution ports such that one pump may feed two or more lanes of the conveyor. Where the pump feeds two lanes, it is preferred to locate the pump centrally such that the distance to each nozzle is essentially equal and the ports are identical such that a consistent even distribution of product between nozzles is achieved. Although some accuracy in the fill quantity may be lost, it may still be within acceptable tolerances and the resulting cost savings could justify such a system. As can be appreciated the cost savings is not only the initial cost of purchasing the pumping unit but also the cost to maintain the units.

It should be pointed out that although this pumping system is designed to be cleaned in place the high quality control standards set by the dairy industry will necessitate the units being completely disassembled and thoroughly sterilized on an intermittent basis. However, the present invention allows the required frequency for disassembly to be decreased and it is therefore an attractive machine from a producers point of view without sacrificing the high quality control demanded by the industry as a whole.

Figure 5:
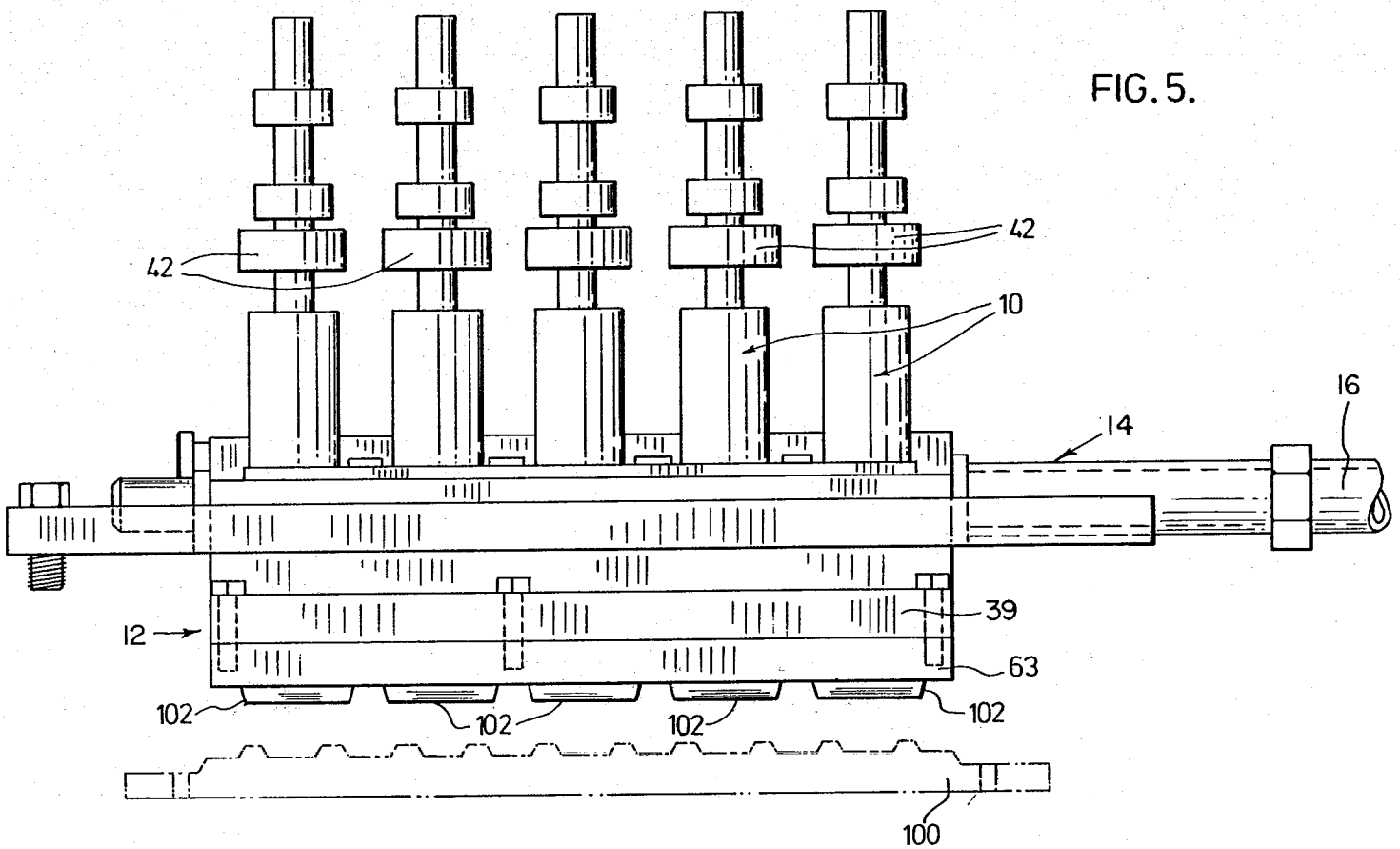
FIG. 5, is a rear view of the combination pump and nozzle units of FIG. 4.

As can be seen in FIG. 5 the pumping unit is shown above the conveyor bed 100 with the spacing between the nozzles 102 and this bed being quite small. It can be appreciated that it is desirable to have this spacing fairly small as problems due to product splash tend to increase as the spacing becomes larger. Products splash is also a function of the speed of the product as it is filling the container and the fill rate has been decreased according to this invention by providing two filling stations.

The small spacing between the conveyor bed 100 and the nozzles 102 causes difficulties in securing the steam cleaning plate 41. The components of the pumping system and the steam plate normally are made of stainless steel and can be of considerable weight which increases the difficulty in properly locating and securing the nozzle plate, to seal the unit for cleaning. This problem has been overcome due to the unique method in which the steam plate is secured and aligned as shown in FIG. 4.

The operator need only place the steam plate on the conveyor roughly aligned with the pumping unit and then on the upper side of the pumping unit through bolts 47 engaging threaded apertures 51 start to lift the nozzle plate towards the nozzles 102. As the steam plate is lifted bracket 43 contacts the aligning pins 45 and the nozzle plate 63 to assure proper location of the steam plate with the nozzles. Therefore, the operator can readily secure the steam plate by adjusting the bolts 47 which are accessible at the top of the pumping units with the steam plate adapted to self-align. As shown in the drawings, the nozzles used in the combined pumping units are each held in a common nozzle plate 63. This is a preferred feature to simplify the sealing of the nozzles with the steam plate by providing one planar surface for engaging the steam plate.

A more full appreciation of the steam plate can be obtained from reviewing FIG. 7 where it is shown the plate 41 has a number of recesses 120 for aligning with nozzles 102 with all these recesses being interconnected by channels 122. To the exterior of the recesses a groove 124 has been provided for housing a suitable sealing O-ring 126 made of a silicone material.

Figure 6:
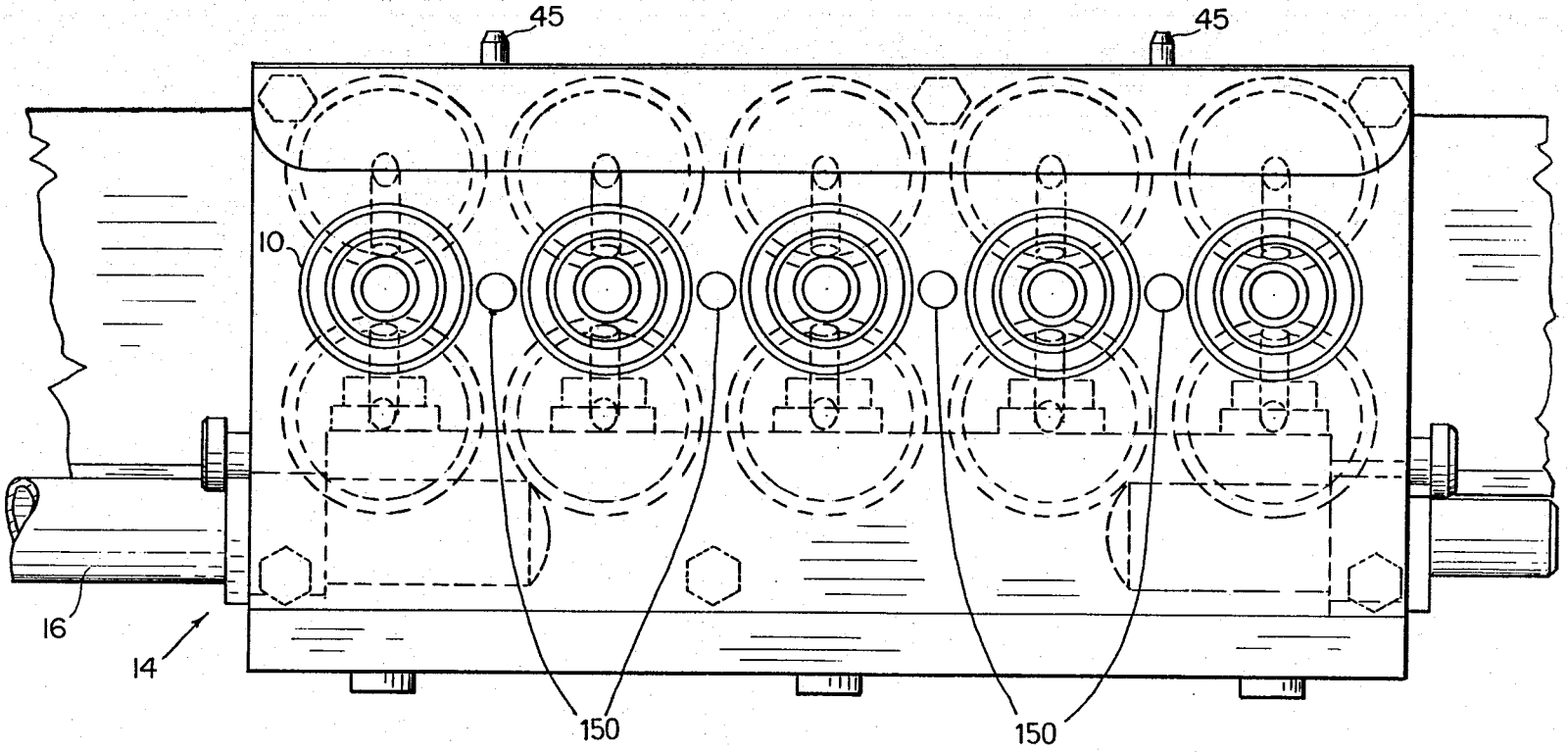
FIG. 6, is a cross-section taken along the line 6—6 of FIG. 4.

FIG. 6 is a cross-section taken along line 6-6 of FIG. 4 and clearly indicates how the apertures 150 which journal bolts 47 are clearly accessible at the top of the pumping unit and can be adjusted by socket wrench for positioning and securing steam plate 41 for steam cleaning.

The present invention provides a unique compact system and allows the overall pumping unit to be cleaned in place while maintaining the high quality control standards required of the dairy industry. Furthermore, the pump has been combined with a nozzle arrangement such that the two components cooperate with one another to provide a very compact and simple system. Due to this simple design and cooperation of components, effective cleaning of the device in place is possible. Furthermore, the design allows piston face and particularly the O-ring of the piston to be placed in flow path of the steam during the cleaning operation, thus assuring a more thorough and effective cleaning of these ports. This thorough cleaning is required as any bacteria remaining on the surfaces would quickly grow and contaminate the product being dispensed and hence reduce the shelf life of the products.

Although various embodiments of the invention have been described herein in detail, it will be understood by those skilled in the art that variations may be made thereto without departing from the spirit of the invention and the scope of the appended claims.

The embodiment of the invention in which an exclusive property of privilege is claimed are defined as follows:

1. A fluid dispensing piston pump to be cleaned in place having an operating position and a cleaning position comprising a cylinder having an area of larger diameter adjacent the lower end, a closing member adjacent the lower portion of said cylinder and housing, an outlet check valve, a piston member having a face portion and a stem portion, said stem portion extending outwardly along the axis of said cylinder away from said closing member, an inlet check valve located below top dead centre of the piston pumping stroke, sealing means associated with said stem for enaging the upper end of said cylinder when said piston member is lowered into said cylinder for cleaning of the apparatus, such that said face is within the cylinder area of larger diameter breaking the seal between said piston face and cylinder wall, the arrangement being such that high temperature steam or a cleaning fluid may be introduced through said inlet check valve to fill the cylinder chamber when said piston is positioned for cleaning to sterilize the components of the pump including the piston face and stem without disassembling the pump wherein the upper end of said cylinder is normally open and said sealing means is secured to said stem and adapted to engage the upper end of said cylinder when said piston face is positioned within the cylinder area of larger diameter.

2. A fluid dispensing pump as claimed in claim 1, further including control means for determining the rate of steam discharge through the pump during the steam cleaning operation.

3. A fluid dispensing pump as claimed in claim 1, adapted for cleaning with a cleaning fluid and including means for recirculating such fluid through the system.

4. A fluid dispensing piston pump and nozzle having an operating position and a cleaning position comprising a normally open ended cylinder having an area of larger diameter adjacent the lower end, a nozzle member closing the lower portion of said cylinder and housing an outlet check valve, a piston member having a face and stem portions, said stem portion extending outwardly along the axis of the open ended cylinder, an inlet check valve located below top dead centre of the piston pumping stroke, sealing means associated with said stem for engaging the open end of said cylinder when said piston member is lowered into said cylinder for cleaning of the apparatus such that said face is within the cylinder area of larger diameter, and closing means for engaging said nozzle member during the cleaning operation, the arrangement being such that high temperature steam or a cleaning fluid may be introduced through said inlet check valve to fill the cylinder chamber and nozzle member to sterilize the components of the pump and nozzle including the piston face and steam without disassembling the pump and nozzle.

5. A fluid dispensing pump and nozzle as claimed in claim 4, wherein said sealing means includes a stationary member secured to the piston stem and sized to provide abutting contact with the open cylinder when the piston has been lowered to the cleaning position.

6. A fluid dispensing pump and nozzle as claimed in claim 4, wherein said inlet check valve is positioned adjacent the periphery of the piston face when the piston is in the cleaning position.

7. A fluid dispensing pump and nozzle as claimed in claim 4 adapted to be steam cleaned in place and further including a valve for controlling the release of steam from the pump and nozzle.

8. A fluid dispensing pump and nozzle as claimed in claim 7, wherein said valve is part of said closing means.

9. A fluid dispensing pump and nozzle as claimed in claim 4, wherein said closing means is a plate member adapted to sealingly engage said nozzle member.

10. A fluid dispensing pump and nozzle as claimed in claim 9, wherein said plate member is adapted to self-align with said nozzle member through the interaction of a bracket secured to the nozzle plate and pin members associated with said nozzle member.

11. A fluid dispensing pump and nozzle as claimed in claim 9 adapted to self-align with said nozzle member and wherein said plate member is lifted and secured to said nozzle member by bolts which threadingly engage said plate member, the head of said bolts being accessible from above the pump.

* * * * *